United States Patent [19]

Kousokabe

[11] 4,343,599

[45] Aug. 10, 1982

[54] SCROLL-TYPE POSITIVE FLUID DISPLACEMENT APPARATUS HAVING LUBRICATING OIL CIRCULATING SYSTEM

[75] Inventor: Hirokatu Kousokabe, Totsukamachi, Japan

[73] Assignee: Hitachi, Ltd., Tokyo, Japan

[21] Appl. No.: 120,885

[22] Filed: Feb. 12, 1980

[30] Foreign Application Priority Data

Feb. 13, 1979 [JP] Japan ..... 54-14229

[51] Int. Cl.[3] ..... F01C 1/02; F01C 21/04; F04C 18/02; F04C 29/02

[52] U.S. Cl. ..... 418/55; 418/88; 418/100; 418/DIG. 1; 417/410; 417/902

[58] Field of Search ..... 418/55, 88, 100, DIG. 1; 417/410, 902

[56] References Cited

U.S. PATENT DOCUMENTS

| | | | |
|---|---|---|---|
| 2,313,387 | 3/1943 | McArthur et al. | 418/100 |
| 3,544,240 | 12/1970 | Rundell | 417/902 |
| 3,884,599 | 5/1975 | Young et al. | 418/55 |
| 3,905,729 | 9/1975 | Bauer | 418/DIG. 1 |
| 3,924,977 | 12/1975 | McCullough | 418/55 |
| 4,091,638 | 5/1978 | Mitch | 417/902 |
| 4,216,661 | 8/1980 | Tojo et al. | 418/55 |

FOREIGN PATENT DOCUMENTS

| | | | |
|---|---|---|---|
| 3499 | of 1926 | Australia | 418/100 |
| 147656 | 11/1936 | Austria | 418/100 |
| 53-119412 | 10/1978 | Japan . | |

*Primary Examiner*—John J. Vrablik

*Attorney, Agent, or Firm*—Craig and Antonelli

[57] ABSTRACT

A scroll-type compressor constituted by a stationary scroll and a revolving scroll, and an electric motor for causing a revolving motion of the revolving scroll are disposed in a closed container. The scroll-type compressor has openings which are adapted to permit fluid compression pockets between two scrolls to be communicated with the space inside the closed container when the pressure in the pockets have been increased to a predetermined pressure intermediate between the suction and discharge pressures, so that the pressure in the closed container may be maintained at the same level as the above-mentioned predetermined pressure. The bottom part of the closed container constitutes an oil well where the lubricating oil is stored. This oil well is connected to the suction side of the compressor through an oil feed passage constituted by a capillary tube, so that the oil is fed to the compressor due to the pressure difference between the space inside the closed container and the inlet side of the compressor. An oil separating tank is disposed at the discharge side of the compressor. The lubrication oil separated by this oil separating tank is returned back into the closed container by the pressure differential between the discharge side of the compressor and the interior of the closed container.

10 Claims, 7 Drawing Figures

SCROLL-TYPE POSITIVE FLUID DISPLACEMENT APPARATUS HAVING LUBRICATING OIL CIRCULATING SYSTEM

BACKGROUND OF THE INVENTION

The present invention relates to a scroll-type fluid displacement apparatus which is adapted to compress, expand and pump-up a fluid and, more particularly, to a small-sized and closed scroll-type fluid displacement apparatus suitable for use as a refrigerant compressor for household electric appliances such as refrigerator, air conditioner or the like.

Scroll-type fluid displacement apparatus for treating fluids has been disclosed in, for example, the specification of U.S. Pat. No. 3,884,599 entitled "SCROLL-TYPE POSITIVE FLUID DISPLACEMENT APPARATUS", the specification of U.S. Pat. No. 3,924,977 entitled "POSITIVE FLUID DISPLACEMENT APPARATUS" and so forth.

In this scroll-type fluid displacement apparatus, two plates, each having a spiral wrap of a uniform height arranged on a flat surface, are disposed to oppose to each other, such that the upper end surface of the wraps are held in contact with the flat surfaces of the opposing plates. As one of the plates is rotated, the volume of a pocket defined by a pair of wraps and plates is changed to perform the displacement of a fluid. The principle of operation of this apparatus will be described with specific reference to FIGS. 1 to 4.

FIGS. 1 to 4 illustrate only a pair of wraps while neglecting the flat plates. Referring to these Figures, the scroll-type fluid displacement apparatus includes a stationary scroll wrap 1*a*, and a revolving scroll wrap 2*a*, with a discharge port 3 located in the vicinity of the center 0 of the stationary scroll wrap 1*a*. The center P of the revolving scroll wrap is adapted to revolve round the center 0 of the stationary scroll wrap 1*a* at a radius of R. A relative movement is performed such that the walls of the scroll wraps 1*a*, 2*a* are held always in contact and the point of contact is moved continuously. Closed fluid pockets 4 are formed by the positional relationship between two scroll wraps as stated above. To assist the understanding, one of the fluid pockets 4 is hatched in FIGS. 1 to 4. This fluid pocket 4 is moved from the radially outer extremity toward inside as the revolving scroll 2*a* rotates, as shown successively in FIGS. 1 to 4, to reduce its volume gradually. Therefore, the fluid in the pocket is pressurized to the maximum pressure in the state shown in FIG. 4, and is discharged to the outside through the discharge port 3. This apparatus can serve as a compressor, provided that means for maintaining a high pressure is disposed on the extension of the discharge port 3.

When this scroll-type apparatus is used as a compressor, the high pressure of the fluid established in the fluid pocket 4 acts to separate the rotary scroll from the stationary scroll. This force will be referred to as "axial force" hereinafter, because it acts in the same direction as the shaft such as crank shaft for rotatively driving the revolving scroll. For an efficient use of this apparatus as a compressor, it is necessary to employ suitable means for continuously applying a force counter-acting this axial force. In each of the stationary and rotary scrolls, the end portion of the scroll is maintaining a sliding contact with a mirror-finished surface of the opposing plate. It is, therefore, necessary to provide suitable sealing means for preventing the fluid from leaking through the portions of sliding contact.

FIG. 5 shows examples of the means for counteracting the axial force and sealing means at the ends of the scroll wraps 1*a*, 2*a* suitably used in the scroll-type compressor. More specifically, FIG. 5 is a sectional view showing an essential part of the scroll-type compressor. In this Figure, a stationary scroll 1 and a revolving scroll 2 having spiral wraps 1*a* and 2*a*, respectively. The revolving scroll 2 is adapted to be driven by a drive shaft 2*c* which is coupled to a crank shaft 7 through a bearing. The center of the drive shaft 2*c* is offset from the center of the crank shaft 7, so that the rotary scroll 2 revolves around the center of the stationary scroll 1 as the crank shaft 7 rotates. The crank shaft 7 is carried by the main frame 6 by means of bearings. A ring 11*a* having a key way and a key 11*b* in combination constitute rotation-prevention means adapted to prevent the revolving scroll 2 from rotating around its own axis, thereby ensuring the revolution of the same around the center of the stationary scroll 1. A suction and discharge ports 15 and 3 are connected to other components through pipes, so that the apparatus may function as a compressor.

In this scroll-type compressor, a thrust bearing 8 is disposed between the revolving scroll 2 and the crank shaft 7 to bear the aforementioned axial force. Namely, this thrust bearing 8 constitutes the means counteracting the axial force. As the means for providing a seal between the ends of the scroll wraps 1*a*, 2*a* and the mirror-finished surfaces 5, there is provided a sealing means at the end of each scroll wrap 1*a*, 2*a* which includes: a groove formed in the end surface of each scroll wrap 1*a*, 2*a*; a sealing member 9 disposed in the groove and a biasing means 10 such as a cord made of an elastic member and adapted to press the sealing member 9 against the mirror-finished surface 5 of the opposing scrolls 1, 2.

The following problems are caused when this type of compressor is used as a comparatively small-sized compressor such as the compressor for household electric appliances.

Generally speaking, it is not practical to replace essential parts of domestic electric appliances. It is therefore necessary that the essential parts such as compressor operates for a long time without repair. However, the thrust bearing 8 bearing the axial force cannot fulfill this requirement because of the limited life of the lubrication. Thus, this arrangement cannot be practically used.

Also, the sealing means provided at the scroll wrap ends, constituted by the sealing member 9 and the biasing means 10, incurs various inconveniences such as increase of number of parts, difficulty in processing and so forth. Further, the sealing members and the biasing means are extremely small in the small-sized compressors resulting not only in the enhanced difficulty in processing but also in the necessity of replacement due to wear or distortion on the way of use. Thus, the conventional scroll-type compressor could not be practically used for domestic electric appliances.

SUMMARY OF THE INVENTION

It is, therefore, an object of the invention to provide a small-sized and highly reliable scroll-type fluid displacement apparatus which can suitably be used as a closed-type compressor for household electric appliances.

To this end according to the invention, there is provided a scroll-type fluid displacement apparatus wherein a stationary and revolving scrolls, mechanism for driving the revolving scroll, driving source and so forth constituting the apparatus are accommodated by a closed vessel or container. An opening is provided for communication with the space inside the closed container when the fluid pocket defined by the scrolls takes a certain volume to maintain a pressure in the closed container at a level intermediate between the pressures at the suction and delivery sides of the compressor. The apparatus further has an oil feeding passage opening at its one end to a lubricant well in the closed container and to the suction side of the compressor at its other end, and an oil returning passage opening at its one end to the delivery side of the compressor and to the inside of the closed container at its other end.

According to the above-explained feature of the invention, the lubricating oil is effectively supplied to the suction side of the compressor due to the pressure differential between the space inside the closed container and the suction side. As a result, a smooth circulation of lubricating oil is ensured, while effective seals are formed at the ends of the scroll wraps. It is, therefore, possible to obtain a highly reliable and maintenance-free compressor suitable for use in household electric appliances and the like.

DESCRIPTION OF THE PREFERRED EMBODIMENTS

Figure 6:
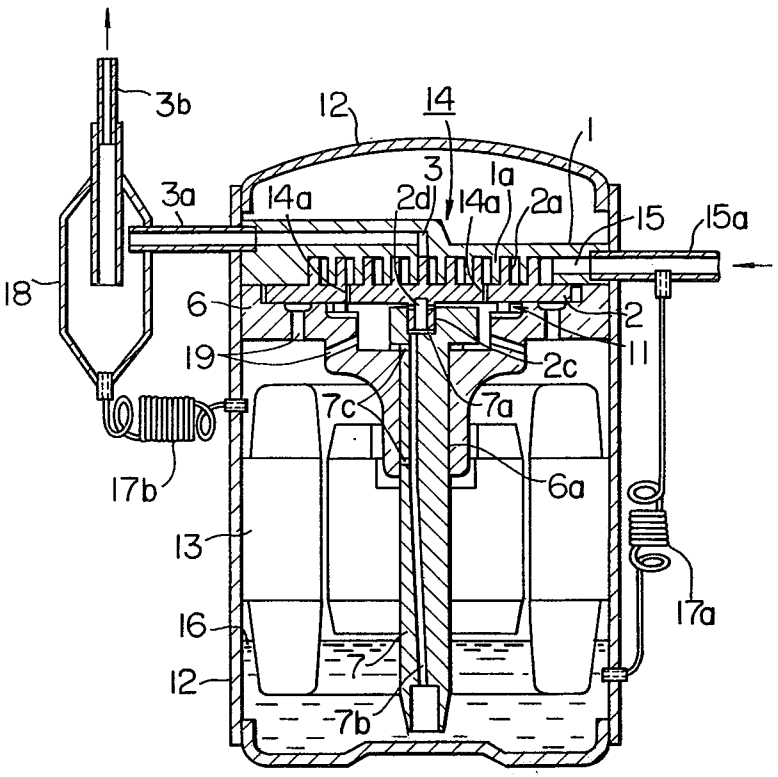
FIG. 6 is a sectional view of a closed scroll-type compressor constructed in accordance with an embodiment of the invention.

Referring first to FIG. 6 showing an embodiment of the invention, a compressor generally designated by the reference numeral 14 and an electric motor 13 are disposed in a closed container 12 the inside air of which is sealed against the ambient air. The compressor 14 includes a stationary scroll 1 and a revolving scroll 2, and is mounted at an upper part of the space inside the container 12 by means of a main frame 6. The electric motor 13 is mounted at a lower part of the space inside the container 12 such that a crank shaft 7 for driving the revolving scroll 2 of the compressor 14 extends substantially vertically.

A main bearing **6*a* is formed at the center of the main frame 6 unitarily with the latter and supports the crank shaft 7 the lower end portion of which being formed unitarily with the rotor shaft of the electric motor 13. A bearing 7*a* formed at the upper end of the crank shaft 7 has a center which is offset from the center of the crank shaft 7, and is engaged by a drive shaft 2*c* of the revolving scroll 2. The revolving scroll 2 is disposed to oppose to the stationary scroll 1 which is fixed to the main frame 6, and is adapted to revolve stably thanks to the provision of the rotation-prevention means 11, to perform a compressing action in the manner described before in connection with FIGS. 1 to 4**.

The rotation-prevention means 11 is constituted by a key fixed to the main frame 6, a ring slidable along this key, a second key fixed to the revolving scroll 2, and a keyway formed in the ring to permit the second key to slide in the direction perpendicular to the direction of sliding of the ring itself.

A suction port 15 has a suction pipe **15*a* connected thereto, with the suction pipe 15*a* introducing the fluid to be compressed by the compressor 14. Also, a discharge pipe 3*a* for introducing the fluid compressed by the compressor 14 is connected to a discharge port 3. The lower part of the closed container 12 constitutes an oil well in which a lubricating oil 16 is accumulated. This lubricating oil 16 is fed to various portions of the compressor 14** by means of a lubrication system which will be described later.

In the scroll-type compressor of the invention, the axial force is born by a dynamic means having the following construction.

Theoretically, the axial force, which acts to separate the revolving scroll 2 away from the stationary scroll 1, can be born by a force which acts to press the revolving scroll 2 against the stationary scroll 1. As a measure for generating such a counter-acting force, it is considered necessary to maintain a high pressure in the closed container 12. To this end, the pressure in the closed container 12 can advantageously be maintained at a level intermediate between the pressure at the suction side and the pressure at the discharge side of the compressor 14. By so doing, a force is externally applied to the revolving scroll 2 in the direction opposite to the direction of the axial force, so that the latter can effectively be nullified. Since any specific external dynamic means such as a thrust bearing is eliminated, the compressor is relieved from the problem caused by such a bearing, and the number of parts of the compressor can be reduced advantageously.

As the means for maintaining a pressure in the closed container 12 intermediate between the suction and discharge pressures, it is possible to use an invention of U.S. patent application Ser. No. 887,252 of the same Assignee, corresponding to Japanese Patent Laid-open Publication No. 119412/1978 laid open to public inspection on Oct. 12, 1978. Namely, this can be achieved, as shown in FIG. 6, by providing openings **14*a* which permit the fluid pockets defined by the revolving and stationary scrolls 1, 2 and their wraps 1*a*, 2*a* to communicate with the space inside the closed container 12 when the pressure in each fluid pocket has reached a predetermined pressure. The pressure in the closed container 12 can be set at any desired level intermediate the suction and discharge pressures by suitably selecting the positions of the openings 14*a*. A perfect seal at the end of each scroll wrap 1*a*, 2*a* is required also for maintaining the desired pressure in the closed container 12 with the means including the openings 14*a***.

Generally, it is a known measure to seal the gap between two members moving relatively to each other by means of an oil film of a lubricating oil which, of course, provides also a lubrication. In the described embodiment of the invention, this type of sealing means are adopted for sealing the gaps between the ends of the scroll wraps **1*a*, 2*a* and cooperating walls of the scrolls 1, 2. For adopting this sealing means to a scroll-type compressor 14, said supply of lubricating oil 16 to the sliding surfaces is essential because the sliding parts have considerably large areas. In addition, in order to ensure the supply of lubricating oil 16 to other sliding parts of the compressor 14**, e.g. bearings, it is necessary that the collection of the used lubricating oil, as well as the returning of the same to the oil supply source, has to be made smoothly and without fail. This requisite is important particularly in the closed-type compressors.

Hereinafter, a description will be made as to a lubrication oil circulating system which well meets the above-described requirement. The bottom part of the closed container 12 in which the lubricating oil 16 is accumulated is communicated by means of a capillary tube 17*a* with the suction pipe 15*a* through which the fluid to be compressed is introduced. As the compressor is started, the lubricating oil 16 is sucked into the suction pipe 15*a* through the capillary tube 17*a* from the closed container 12, because of a pressure differential created between the space in the closed container 12 and the suction pipe 15*a*, and is fed to the compressor without fail together with the fluid to be compressed. Any desired rate of lubricating oil supply is obtainable by a careful selection of the inside diameter of the capillary tube 17*a* and the length of the same.

A part of the lubricating oil in the compressor 14 is discharged from the discharge port 3 together with the compressed fluid. To collect this lubricating oil carried by the discharged fluid, the discharge pipe 3*a* is connected to a component (not shown) needing the compressed fluid via an oil separating tank 18, through a pipe 3*b*. The oil separating tank 18 is so arranged that the pipes 3*a*, 3*b* introduce the compressed fluid along a non-linear path. By so doing, the oil carried by the compressed fluid is separated from the latter due to the action of the centrifugal force and/or force of gravity, and is accumulated in the lower part of the oil separating tank 18 in the form of droplets. The bottom portion of the oil separating tank 18 is communicated through a capillary tube 17*b* with the space in the closed container 12, so that the collected lubricating oil is effectively returned to the space in the closed container 12 due to the pressure differential between the discharge side of the compressor 14 and the space inside the closed container 12. The rate of return of the lubricating oil can be adjusted by suitably selecting the inside diameter and the length of the capillary tube 17*b*. Preferably, the inside diameter and the length of the capillary tube are so selected as not to permit a large amount of lubricating oil to remain in the oil separating tank 18.

According to this construction of the scroll-type compressor 14, the lubricating oil 16 is continuously circulated to always maintain an oil film at the end of each scroll wrap 1, 2 to ensure an effective seal against the leakage of the fluid.

Since the passages for feeding and returning of the lubricating oil are provided by the capillary tubes 17*a*, 17*b*, sufficient pressure differentials are preserved between the suction side and the closed container 12 and between the closed container 12 and the delivery side, in spite of the presence of these passages, if a setting is made such that the capillary tubes 17*a*, 17*b* are filled with the lubricating oil always during running of the compressor.

Hereinunder, a description will be made as to how the lubricating oil 16 is fed to and returned from the portion other than the compressor 14. The crank shaft 7 has a through bore 7*b* which extends in the axial direction of the crank shaft but is offset from the axis of the latter. More specifically, this eccentric oil feed bore 7*b* is so inclined that it takes the central portion at the lower end of the crank shaft 7 but is offset radially outwardly at the upper part of the same. Therefore, as the crank shaft 7 is rotated, a pumping action is caused by the centrifugal force acting on the oil residing in the oil feed bore 7*b*, so that the lubricating oil 16 ascends continuously along the oil feed bore 7*b*. The lubricating oil 16 is then fed to the main bearing 6*a* through a transverse bore 7*c* which is formed at the upper end or an intermediate portion of the crank shaft 7 so as to permit the oil feed bore 7*b* to communicate with the exterior of the crank shaft 7. The lubricating oil which has been introduced to the upper end of the eccentric oil feed bore 7*b* is delivered to the bearing 7*a*, whereas the remainder oil is scattered through an oil feed port 2*d* formed in the revolving scroll drive shaft 2*c* thereby to effect lubrication in the sliding part of the rotation-prevention means 11, as well as the sliding part between the back side of the revolving scroll 2 and the main frame 6. The excessive lubricating oil 16 is returned to the bottom of the closed container 12 through an oil return bore 19 formed in the main frame 6. Thus, the sealing at the ends of scroll wraps 1*a*, 2*a* as well as feed and return of lubricating oil 16 to and from the sliding parts, is smoothly and stably continued during running of the compressor.

Figure 1:
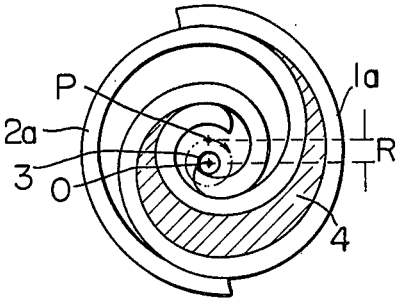
FIGS. 1 to 4 are plan views showing the positional relationships between a pair of scroll wraps of a scroll-type fluid displacement apparatus, for explaining the principle of operation of the apparatus.
Figure 2:
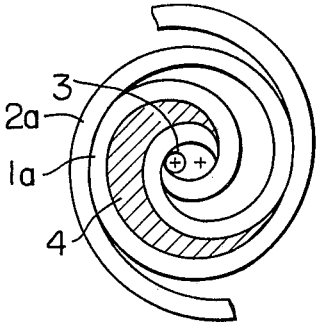
Figure 3:
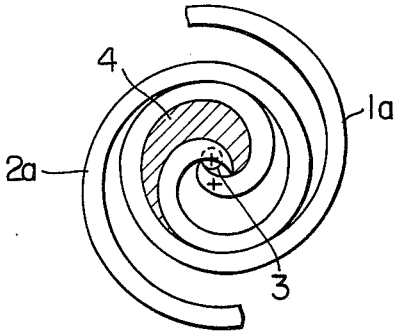
Figure 4:
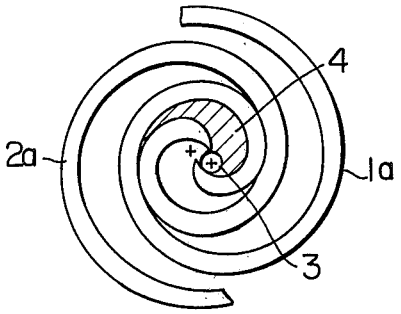
Figure 5:
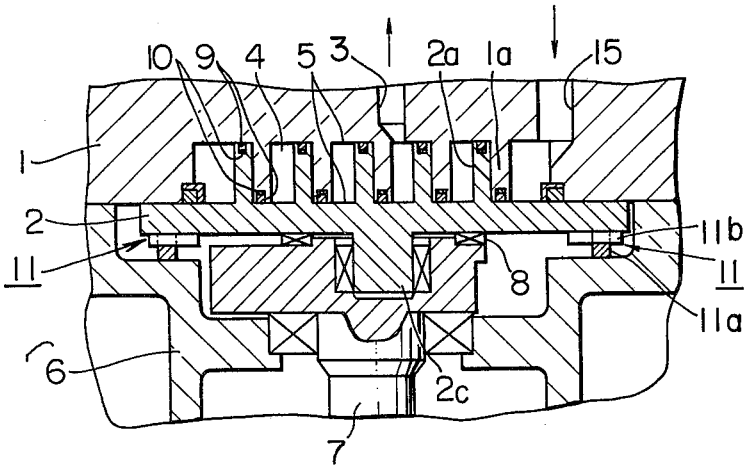
FIG. 5 (PRIOR ART)
FIG. 5 is a sectional view showing an example of essential part of a conventional scroll-type fluid displacement apparatus.
Figure 7:
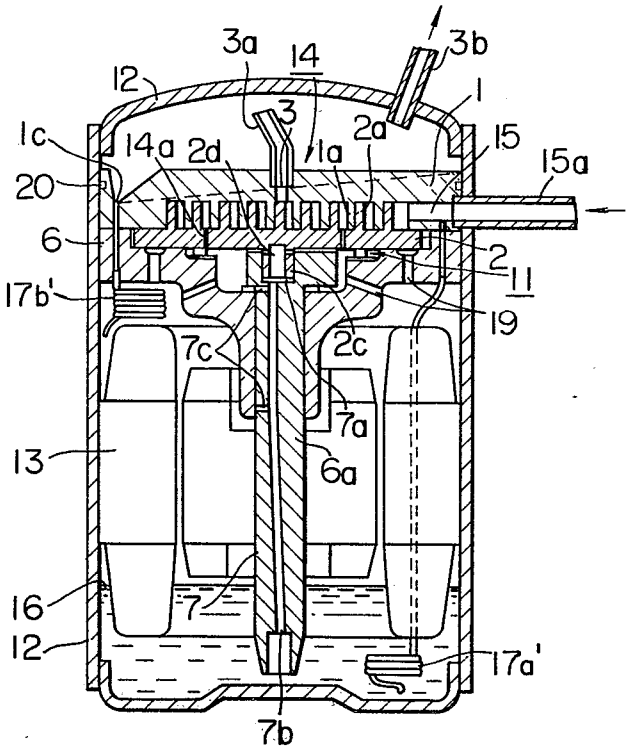
FIG. 7 is a sectional view of a closed scroll-type compressor of the invention having another form of passage for circulation of lubricating oil.

Referring now to FIG. 7 showing another embodiment of the invention, this second embodiment differs from the first embodiment shown in FIG. 6 in that the capillary tubes 17*a*', 17*b*' for feeding and returning of the lubricating oil 16 are disposed at the inside of the closed container 12 in contrast to the first embodiment in which these tubes are mounted outside of the closed container, and that the oil separating tank constitutes a part of the constituent of the closed container 12, thereby reducing the number of parts as a whole and reducing the space occupied by the compressor.

In this embodiment, the upper part of the space inside the closed container 12 is completely separated from the lower part of the same by means of a seal ring 20 disposed around the stationary scroll 1, so that the pressure in the upper part may be maintained at the same level as the discharge pressure. The discharge pipe 3*a* connected to the discharge port 3 of the compressor 14 is opened to the space inside the closed container 12 so that the lubricating oil discharged together with the compressed fluid may fall onto the upper surface of the stationary scroll 1. The falling oil is then gathered at a groove 1*c* formed in the upper surface of the stationary scroll 1, and is returned to the lower part of the closed container 12 via a bore extending through the stationary scroll 1 and the main frame 6, and then through a capillary tube 17*b*' connected to this bore. The capillary tube 17*a*' for feeding the lubricating oil 16 to the suction side of the compressor 14 is disposed also inside the closed container 12 as illustrated.

The compressed fluid is introduced to a component (not shown) in need of the compressed fluid, through a pipe 3*b* connected to the upper part of the closed container 12. Other parts bearing the same reference numerals as those of FIG. 6 have identical construction and functions as those of the first embodiment.

In the embodiments shown in FIGS. 6 and 7, the crank shaft 7 is formed unitarily with the rotor shaft of the electric motor 13. This, however, is not exclusive. For instance, the arrangement may be such that the lower portion of the crank shaft 7 is extended independently into the lubricating oil 16, while an electric motor having an independent rotor shaft is disposed such that the crank shaft and the rotor shaft are not coaxial but connected to each other by a known transmission mechanism.

What is claimed is:

1. A scroll-type fluid displacement apparatus having a scroll-type fluid displacement means including a stationary scroll and a revolving scroll, an electric motor for driving said revolving scroll, a closed container containing said fluid displacement and said electric motor, and lubricating oil circulating means for said fluid displacement means, and means provided in in one of the stationary scroll and revolving scroll for enabling a pressure in the closed container to be maintained at a pressure intermediate a suction and discharge pressure of the apparatus, wherein said lubricating oil circulating means include:

means provided in said container and adapted for storing said lubricating oil;

a first lubricating oil passage opened at its one end into said lubricating oil stored in the lubricating oil storing means in said closed container and connected at its other end to the suction side of said scroll-type fluid displacement means so as to enable lubricating oil to be drawn into the scroll type fluid displacement means and form a sealing oil film between the stationary and revolving scrolls;

a second lubricating oil passage connected at its one end to the discharge side of said scroll-type fluid displacement means and opening at its other end to the space inside said closed container; and an oil separating means disposed at an intermediate portion of said second lubricating oil passage.

2. A scroll-type fluid displacement apparatus as claimed in claim 1, wherein said first and second lubricating oil passages include capillary tubes.

3. A scroll-type fluid displacement apparatus having a scroll-type fluid displacement means including a stationary scroll and a revolving scroll which in combination define fluid pockets a volume and position of which change in accordance with the revolution of said revolving scroll so as to compress and displace a fluid from a suction port to a discharge port as said revolving scroll revolves;

an electric motor for driving said revolving scroll; a closed container containing said scroll-type fluid displacement means and said electric motor; and lubricating oil circulating means; said fluid displacement means further including further openings adapted to permit said fluid pockets to communicate with the closed container when the pressure in each fluid pocket is increased so as to enable a pressure in the closed container to be maintained at a pressure level intermediate the pressures at said suction and discharge ports, said openings being formed either in said stationary scroll or said revolving scroll;

wherein said lubricating oil circulating means include:

a lubricating storing means provided in said closed container;

a first lubricating oil passage opened at a first end to said lubricating oil in said lubricating storing means and at a second end to a fluid passage of the suction side of said scroll-type fluid displacement means so as to enable lubricating oil to be drawn into the scroll-type fluid displacement means and form a sealing oil film between the stationary and revolving scrolls;

oil separating means disposed at the discharge side of said scroll-type fluid displacement means and adapted to separate said lubricating oil from said fluid; and a second lubricating oil passage connected at a first end to said oil separating means and opened at a second end to the space inside said closed container.

4. A scroll-type fluid displacement apparatus as claimed in claim 3, wherein said first and second lubricating oil passages include capillary tubes.

5. A scroll-type fluid displacement apparatus as claimed in claim 1 or 3, further comprising a crank shaft for causing the revolving motion of said revolving scroll, said crank shaft being extended such that a lower end is immersed in said lubricating oil in said closed container and having a through bore extending from the lower end to an upper portion thereof, said through bore being inclined to the axis of said crank shaft radially outwardly such that the upper portion of said through bore is spaced from the axis of said crank shaft by a distance which is greater than the distance between the lower portion of said through bore and said axis of said crank shaft, said through bore being opened at its upper end to a portion in the vicinity of a member which is in need of lubrication.

6. A scroll-type fluid displacement apparatus as claimed in any one of claims 1 to 4, wherein said first and second lubricating oil passages are disposed in said closed container.

7. A closed type compressor having a scroll-type fluid displacement means comprising:

a scroll-type compression mechanism including: a stationary scroll having a mirror-finished surface and a scroll wrap formed on said surface to have a uniform height from the latter; a revolving scroll having a mirror-finished surface and a scroll wrap of the same height as said stationary scroll wrap; said stationary and revolving scrolls being disposed opposite to each other such that the ends of scroll wraps slidably contact said mirror-finished surfaces of the opposing scrolls, said scroll warps and said mirror-finished surfaces of said pair of scrolls defining fluid pockets a volume and positions of which change as said revolving scroll revolves, to thereby displace and compress a fluid supplied through a suction port to a discharge port by the movement of said fluid pockets;

a crank shaft mechanism including a crank shaft adapted for causing a revolving action of said revolving scroll;

a closed container constituting at its bottom portion a well for storing the lubricating oil and accommodating therein said scroll-type compression mechanism, crank mechanism and said electric motor;

means for introducing said fluid to be compressed into said suction port of said scroll-type compression mechanism from the exterior of the latter;

means for introducing the compressed fluid discharged from said discharge port of said scroll-type compression mechanism to the outside of said scroll-type compression mechanism;

oil feeding means opened at a first end to the lubricating oil in said closed container and connected at a second end to said means for introducing said fluid into said scroll-type compression mechanism to feed said lubricating oil to said scroll-type compression mechanism upon mixing with said fluid to be compressed so as to enable the lubricating oil to form a sealing oil film between the mirror finished surfaces and opposed portion of the scroll wraps;

oil separating means disposed at the same side of said scroll-type compression mechanism as said means for introducing the compressed fluid and adapted to separate said lubricating oil from said discharged fluid; and oil returning means connected at its one end to said oil separating means and opened at its other end into said closed container thereby to return said lubricating oil separated by said oil separating means back into said closed container.

8. A scroll-type fluid displacement apparatus as claimed in claim 7, wherein openings are provided in one of the stationary scroll and the revolving scroll for permitting corresponding fluid pockets to communicate with the space inside said closed container when said pockets have been moved to positions wherein the pressures established therein are higher than a predetermined pressure whereby a pressure in the closed container is maintained at a level intermediate a suction and discharge pressure.

9. A scroll-type fluid displacement apparatus as claimed in claim 7 or 8, wherein said oil feeding means and said oil returning means include capillary tubes.

10. A scroll-type fluid displacement apparatus as claimed in claims 7 or 8, wherein said crank shaft of said crank mechanism is extended such that a lower end thereof is immersed in said lubricating oil in said closed container the crank shaft has a through bore extending from the lower end to an upper portion thereof, said through bore having a portion which is inclined to a longitudinal axis of said crank shaft such that a distance between said through bore and the axis of said crank shaft is greater at the upper portion than at the lower portion of said crank shaft, said through bore being opened at its upper end to a portion in a vicinity of a member in need of lubrication.

* * * * *